United States Patent [19]

Bradley et al.

[11] 4,418,804

[45] Dec. 6, 1983

[54] REINFORCED SOFT-SIDED LUGGAGE HAVING GROUND SUPPORT WHEELS

[75] Inventors: Leonard R. Bradley, Cumberland; Wayne I. Schmitt, Bristol; Antone F. Macedo, Jr., Manville, all of R.I.

[73] Assignee: American Tourister, Inc., Warren, R.I.

[21] Appl. No.: 333,562

[22] Filed: Dec. 22, 1981

[51] Int. Cl.[3] ..... A45C 13/36; A45C 13/26; B62B 11/00; A45C 5/14

[52] U.S. Cl. ..... 190/18 A; 280/37; 190/127

[58] Field of Search ..... 190/49 (U.S. only), 190/50, 57 (U.S. only), 58 R, 58 A, 58 B (U.S. only), 18 A, 18 R; 280/37

[56] References Cited

U.S. PATENT DOCUMENTS

| | | | |
|---|---|---|---|
| 2,035,493 | 3/1936 | Mees | 190/49 |
| 2,392,926 | 1/1946 | Kelly | 190/39 |
| 2,596,578 | 5/1952 | McIntyre et al. | 190/18 A |
| 2,745,524 | 5/1956 | Plotkin | 190/57 |
| 2,788,871 | 4/1957 | Arlitt, Jr. | 190/49 |
| 3,592,314 | 7/1971 | Jacobson | 190/49 |
| 3,653,474 | 4/1972 | Sadow | 190/18 A |
| 3,655,215 | 4/1972 | Becklin | 190/18 A X |
| 3,924,872 | 12/1975 | Sollazzi et al. | 280/47.37 |
| 3,944,032 | 3/1976 | Samhammer et al. | 190/41 B |
| 3,977,501 | 8/1976 | Alonso | 190/49 |
| 4,030,768 | 6/1977 | Lugash | 190/18 A X |
| 4,126,213 | 11/1978 | McDonald | 190/18 A |
| 4,210,230 | 7/1980 | Weiner | 190/49 X |
| 4,385,415 | 5/1983 | Volz | 190/18 A |

FOREIGN PATENT DOCUMENTS

| | | | |
|---|---|---|---|
| 2441358 | 7/1980 | France | 190/18 A |
| 2454773 | 12/1980 | France | 190/18 A |
| 1441790 | 7/1976 | United Kingdom | 190/50 |
| 1488008 | 10/1977 | United Kingdom | 190/18 A |
| 2024612 | 1/1980 | United Kingdom | 190/49 |

*Primary Examiner*—William Price
*Assistant Examiner*—Sue A. Weaver
*Attorney, Agent, or Firm*—Burns, Doane, Swecker & Mathis

[57] ABSTRACT

A soft-sided piece of luggage comprises a container portion and a hinged cover including a lateral skirt. The skirt has a peripheral edge adapted for alignment with a peripheral edge of the container portion to accommodate the closure of cooperating zipper parts on the cover and container portion. Interior reinforcing means stiffens the luggage, and comprises a floor plate positioned along the inside of a rear wall of the container portion. The plate includes curved ends extending along rear corners of the container portion. The reinforcing plate projects beyond the peripheral edge of said container portion to shape respective rear and corner portions of the skirt when said cover is closed. A reinforcing U-bar extends along the inside of the container portion and is connected to the floor plate. A pair of curved stiffening plates are disposed at the inside of front corners of the container portion and are reinforced by the reinforcing bar. A pair of curved stiffening stays are removably mounted in pockets along the inside of front corners of the cover to reinforce the latter. Ground support wheels are mounted in recessed fashion to the floor plate and project outwardly from the rear wall of the container portion. A foldable pull strap is mounted on a front end wall of the luggage.

4 Claims, 8 Drawing Figures

Fig. 1
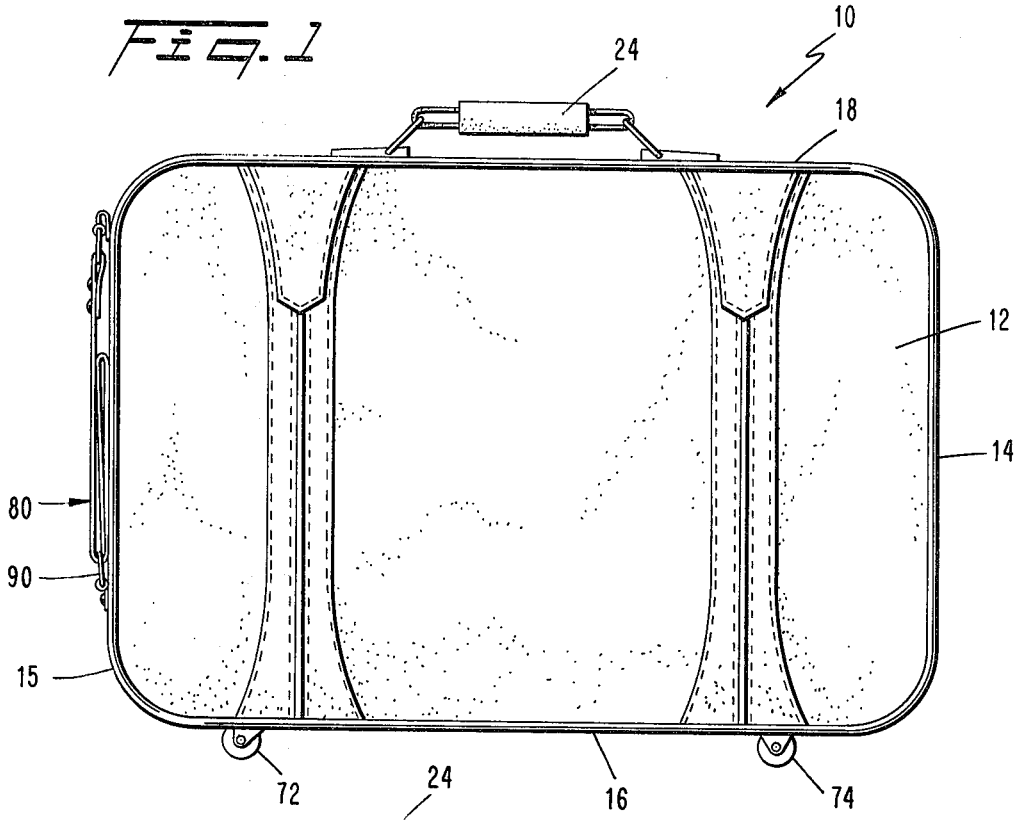
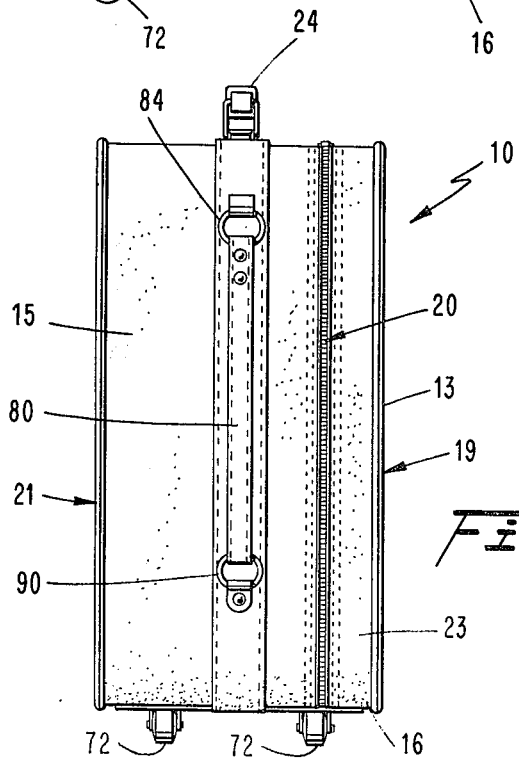
Fig. 2

REINFORCED SOFT-SIDED LUGGAGE HAVING GROUND SUPPORT WHEELS

BACKGROUND AND OBJECTS OF THE INVENTION

The present invention relates to luggage and, in particular, to soft-sided luggage having ground support wheels.

A common type of luggage is "soft-sided" luggage, so-called because its walls are formed of a pliant material, such as real or imitation leather, for example. One of the walls is hingedly mounted and constitutes a cover for the container portion of the luggage. Soft-sided luggage is advantageous in that it is attractive and light in weight. On the other hand, soft-sided luggage can be more difficult to close when full, since the sides tend to bulge outwardly, thereby making it difficult to achieve proper alignment of the sliding fastener elements on the cover and container portions. Also, it is difficult to mount ground support wheels on soft-sided luggage with a sufficient degree of reliability and durability, due to the lack of a sufficiently strong and rigid backing to which the wheels may be mounted.

It is, therefore, an object of the present invention to provide novel soft-sided luggage.

Another object of the invention is to provide soft-sided luggage with adequate support for ground support wheels.

A further object of the invention is to provide soft-sided luggage which facilitates alignment of the closure elements when the luggage is full.

An additional object of the invention is to provide a novel pull strap for wheeled luggage which can be conveniently folded to a stored position.

SUMMARY OF THE INVENTION

These objects are achieved by the present invention which involves a soft-sided piece of luggage of the type having opposite side walls, opposite front and rear walls, and opposite end walls, which walls are formed of a soft material. The rear wall and end walls are joined to form rear corners. The front wall and end walls are joined to form from corners. One of the side walls is hinged to the rear wall and forms a cover which can be swung open and closed about the hinge. The cover includes a lateral skirt having a peripheral edge adapted for alignment with a peripheral edge of the container portion to accommodate the closure of cooperating fasteners on the cover and container portion. Interior reinforcement is provided for stiffening the luggage. Such reinforcement includes a floor plate positioned along the inside of the rear wall. The plate extends along the rear wall and includes curved ends extending along the rear corners. The curved ends project beyond the peripheral edge of the container portion to shape respective rear corner portions of the skirt when the cover is closed. A reinforcing bar extends along the inside of the front end walls and is connected to the reinforcing plate. A pair of stiffening plates are disposed along the inside of the front corners and are retained by the reinforcing bar to reinforce respective front corners of the skirt. Ground support wheels are mounted to the reinforcing plate and project outwardly from the rear wall.

In accordance with the present invention, the reinforcement structure amply shapes the peripheral edges of the cover and container portion to facilitate closing of the luggage even when the luggage is full. Moreover, the reinforcement enables ground support wheels to be mounted to the luggage and absorbs the forces concentrated at those ground support wheels.

Further reinforcement may be provided by the use of curved stiffening stays which are removably mounted in pockets provided along the inside of the front corners of the cover.

The luggage may also be provided with a pull strap attached by an anchor to one of the end walls, the latter being disposed generally vertically when the wheels engage the ground. A lower ring is mounted on the wall below the anchor. A first fastener is mounted on a free end of the strap and a second fastener is mounted on the wall above the ring. The fasteners are mated after the strap has been passed through the ring.

THE DRAWINGS

These objects and advantages of the invention will become apparent from the following detailed description of a preferred embodiment thereof in connection with the accompanying drawings in which like numerals designate like elements, and in which:

FIG. 1 is a side elevational view of a soft-sided suitcase according to the present invention;

FIG. 2 is a front end view of the suitcase depicted in FIG. 1;

DETAILED DESCRIPTION OF A PREFERRED EMBODIMENT OF THE INVENTION

Figure 6:
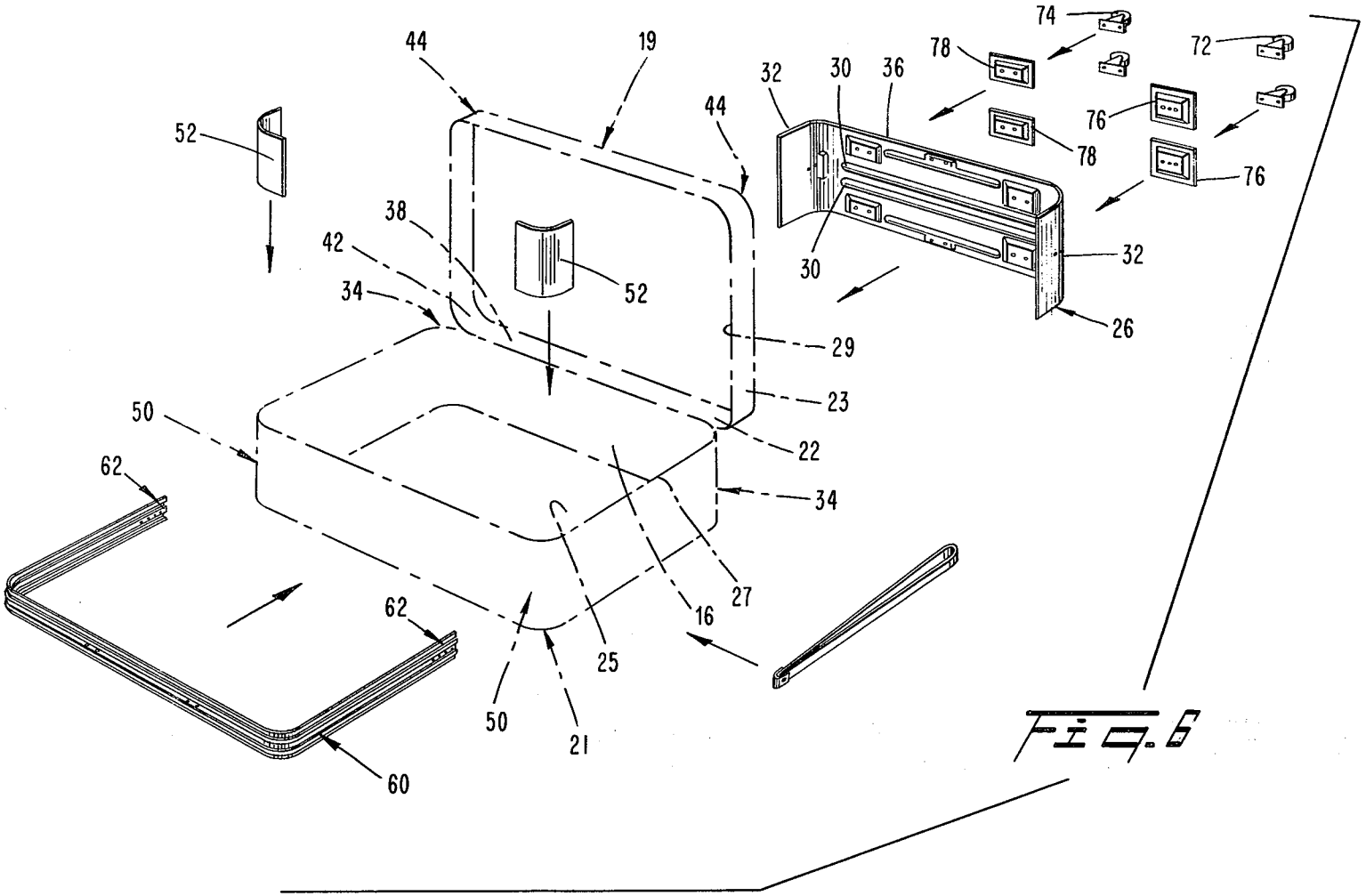
FIG. 6 is an exploded view of the suitcase, depicting some of the various reinforcement components installed therein.

A piece of soft-sided luggage according to the present invention comprises a suitcase 10 which includes two large side walls 12, 13, two end walls 14, 15, a rear wall 16, and a front wall 18, all comprising a pliant "skin" of leather, vinyl, or fabric, for example. One of the side walls 13 is releasably fastened to the front and end walls 18, 14, 15 by means of a sliding fastener 20 to form a cover 19 for a container portion 21 defined by the other side wall 12, the front wall 18, and the end walls 14, 15. The cover 19 swings about a hinge 22 defined by its connection with the rear wall 16 (FIG. 6). The cover 19 includes the side wall 13 and a skirt or lip 23 projecting at right angles to the side wall 13 and to which a part of the sliding fastener 20 is mounted. A carrying handle 24 is provided on the front wall 18 and is connected thereto in conventional fashion.

The container part 21 forms an inner compartment 25 for carrying garments and the like.

Figure 3:
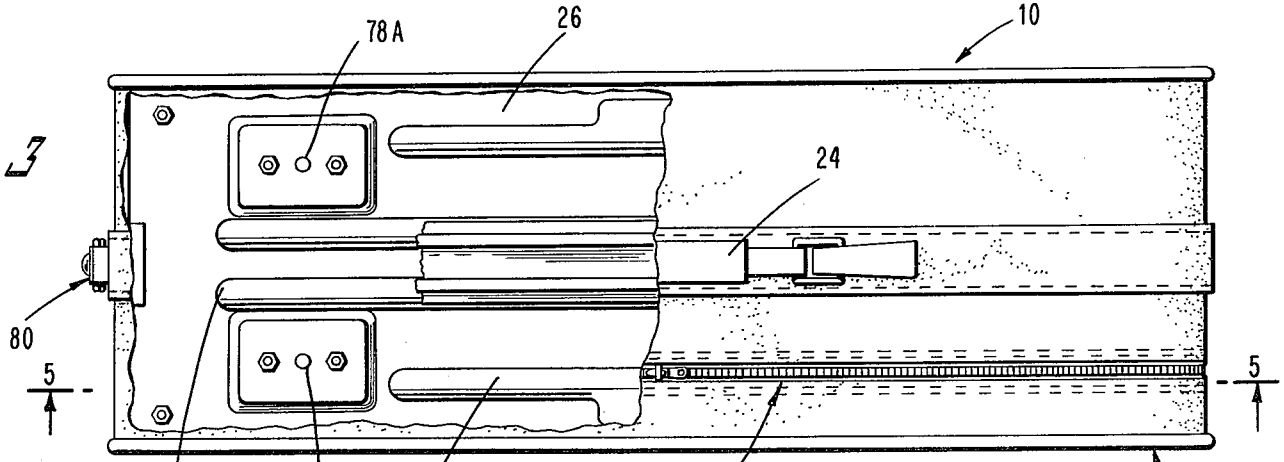
FIG. 3 is a plan view of the suitcase, with a portion of the front wall broken away to expose the rear wall of the suitcase.
Figure 5:
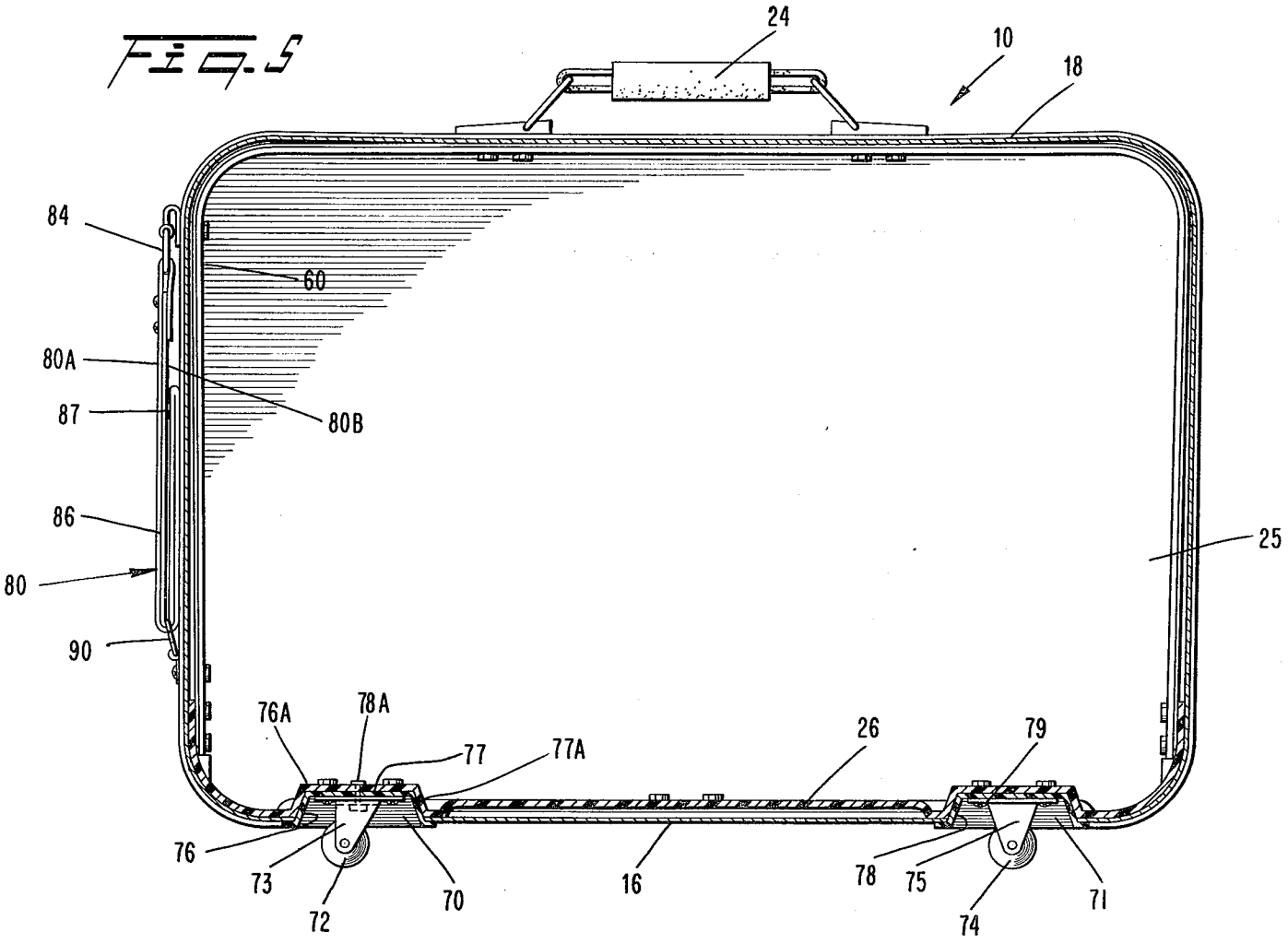
FIG. 5 is a longitudinal sectional view through the suitcase depicted in FIG. 1.

Mounted on the inside of the rear wall 16 is a reinforcing plate or floor 26 (FIGS. 3, 5, and 7) formed of any suitable material, preferably plastic. The floor 26 includes integral stiffening ribs 30 extending parallel to the long dimension of the rear wall. The stiffening ribs 30 could, in the alternative, be formed by separately attachable elements.

Figure 7:
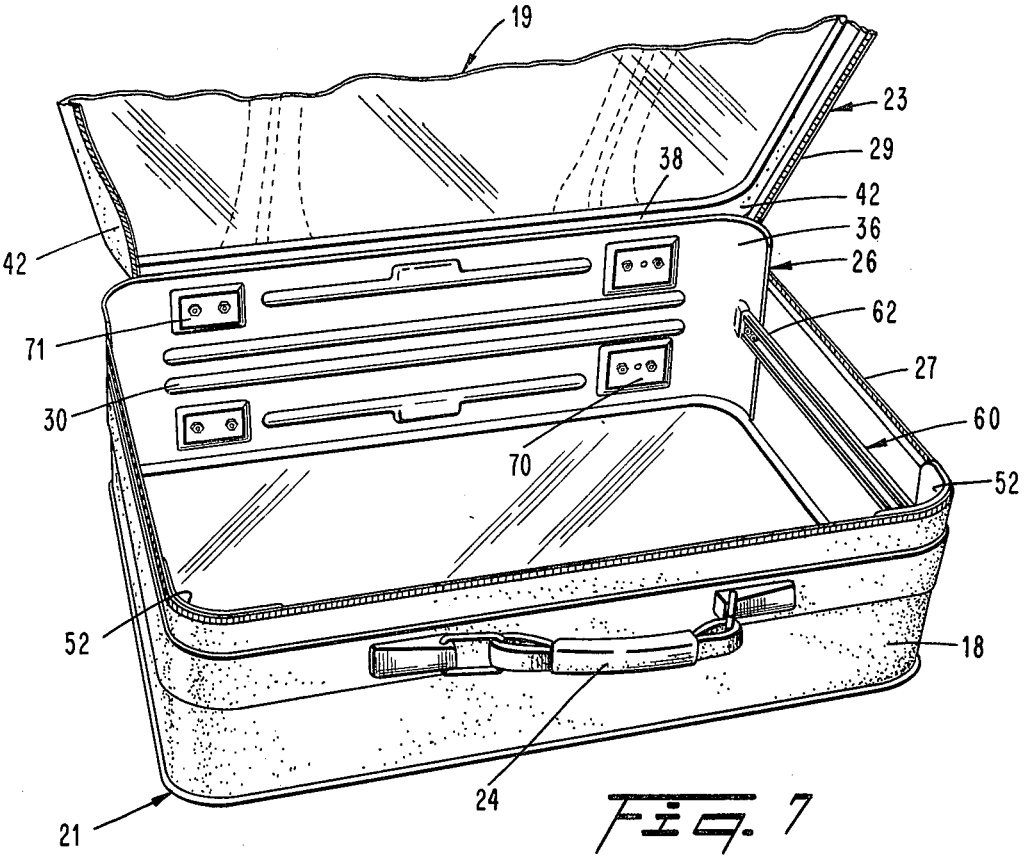
FIG. 7 is a perspective view of the suitcase with the cover opened.

The ends 32 of the floor 26 are curved to extend interiorly around the rear corners 34 of the container portion 21 (FIG. 7). The height of the floor 26 is greater than the height of the end walls 14, 15 and rear wall 16. Accordingly, a portion 36 of the floor 26 extends upwardly from the compartment 25, i.e., beyond the peripheral edge 27 of the container portion to form a brace for the adjacent rear wall 38 and rear corners 42 of the skirt. Thus, when the coverd 19 is closed, the rear corners 42 of the skirt are pulled over the curved ends 32 of the reinforcing plate to align the peripheral edge 27 of the container portion with the peripheral edge 29 of the skirt 23. In this fashion, manipulation of the sliding fastener is facilitated. In practice, a suitable liner (not shown) would overlie the floor 26, the liner being attached to the floor or to the cover 19.

Figure 8:
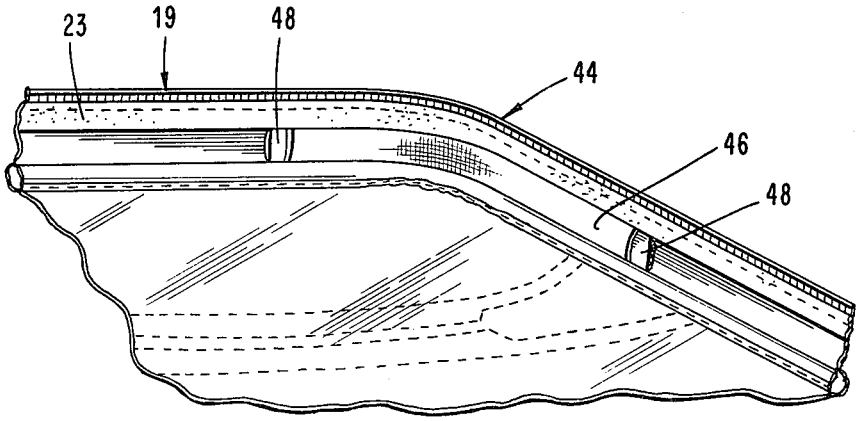
FIG. 8 is a fragmentary view of the suitcase cover depicting a front corner thereof and a removable stay disposed in a pocket in such corner.

Disposed along the inside of the front corners 44 of the cover 19 are pockets formed by strips of material 46 (FIG. 8) sewn to the inside of the skirt 23. Removably insertable within those pockets are curved stiffening stays 48, preferably formed of plastic, which stiffen and shape those front corners 44.

Disposed along the inside of the front corners 50 of the container portion 21 are a pair of curved stiffening plates 52 (FIG. 6) which terminate at the peripheral edge 27 of the container portion 21. The plates 52 stiffen the corners 50 and resist deformation thereof. It will be appreciated that the stiffened front corners 44, 50 of the cover 19 and the container portion 21 retain their shape and are more easily brought into alignment to facilitate manipulation of the sliding fastener 20.

The stiffening plates 52 of the container portion 21 are retained in place behind a reinforcing bar 60 (FIGS. 6–7) which extends around the inside of the front and end walls 18, 14, 15 at a level intermediate the height of those walls. This reinforcing bar is generally U-shaped and is suitably attached to the front end walls 18, 14, 15 as by rivets or screws for example. Ends 62 of the reinforcing bar overlie (rest on the inside of) the corner portion 32 of the reinforcing plate 26 and are secured thereto by suitable fasteners. The stiffening action performed by the bar 60 strengthens the front and end walls and resists deformation thereof. Preferably, the bar 60 is formed of metal although other sufficiently strong materials may suffice.

The combined reinforcement provided by (i) the stiffening stays 48 and stiffening plates 52 in the front corners 44, 50 of the cover 19 and container portion 21, respectively, (ii) the extension 36 of the floor 26, and (iii) the U-bar 60 aids in orienting the peripheral edges 27, 29 of the container portion 21 and cover 19 for proper securement of the sliding fastener 20 when the cover is closed onto the container portion.

Figure 4:
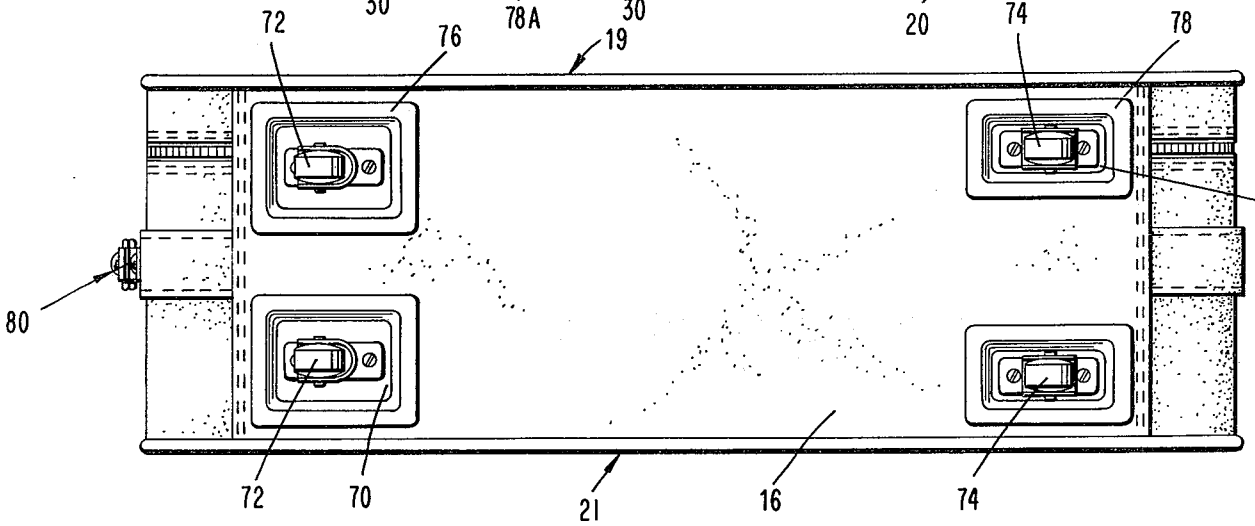
FIG. 4 is a bottom view of the suitcase depicted in FIG. 1.

The floor 26 includes outwardly open recesses or wells 70, 71 (FIGS. 4 and 5) within which are mounted leading and trailing pairs of ground support wheels 72, 74, respectively. Each wheel well includes a base wall 76A and side walls 78A. The wheels are mounted to yokes 73, 75 which are, in turn, secured to mounting plates 77, 79. The plates 79 are fastened to the floor 26. The leading ground wheels 72 are castered for swiveling movement by a pivot 77A which defines an axis extending perpendicular to the rear wall 16. The trailing wheels 74, on the other hand, are fixed in non-swiveling fashion. To accommodate the swiveling motion of the leading ground wheels 72, the leading wheel wells 70 are of enlarged cross-sectional area relative to the trailing wheel wells 71.

Cup-shaped liners 76, 78, preferably formed of plastic, are positioned within the wheel wells 70, 71 to enhance the external appearance of the rear wall 16 of the suitcase. The vinyl skin 16 forming the rear wall is captured between the cups 76, 78 and the floor 26 (FIG. 5), and is thus secured firmly in place.

Affixed to the leading end walls 15 of the suitcase is a pull strap 80. The pull strap 80 comprises a pair of strips 80A, 80B secured to the front end wall 15 by an anchoring ring 84 which is anchored to the U-bar 60. The strips 80A, 80B form a loop 86 which constitutes a grip by which the pull strap is manually grasped for pulling the suitcase, once the strap is unfolded from the folded condition depicted in the figures. At the free end of the strap, a snap-type fastener 87 is secured to one of the strips. This snap fastener 87 is attached to a corresponding externally accessible fastener anchored to the U-bar 60. A lower ring 90 anchored to the U-bar is positioned to admit the strap. The length of the pull strap 80 equals the sum of (i) the distance from the upper ring 84 to the lower ring 90, and (ii) the distance from the lower ring 90 to the snap 87. In practice, the pull strap can be folded to a stored position by inserting the strap through the lower ring 90 and securing the snap 87.

It will be appreciated that the present invention provides a suitably reinforced piece of soft-sided luggage which carries ground support wheels by means of a highly durable mounting arrangement. The loads applied to the wheels are transmitted through the rigid connection between the wheels and floor 26.

Closure of the luggage is facilitated by the extension of the floor which shapes the rear wall and rear corners of the cover skirt, and by the front plates 52 as well as the stiffening stays 48 in the front corners of the skirt.

The foldable pull strap can be made of ample length to facilitate pulling of the luggage, while being compactly and nearly folded-up against the front wall.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. In a soft-sided piece of luggage comprising a container and a cover formed of a soft material; said container including a rear wall and rear corners at opposite ends thereof; said cover being hingedly connected to said rear wall and including a main portion and a skirt depending laterally therefrom; said skirt having a first peripheral edge defining a single plane, and a first zipper track extending around said first peripheral edge, said container including a second peripheral edge defining a single track; a one-piece molded plastic floor plate positioned along the inside of said rear wall and including curved ends extending around said rear corners and terminating adjacent said rear corners, said curved ends projecting beyond said peripheral edge of said container to shape respective rear corners of said skirt when said cover is closed; said one-piece floor plate including a plurality of inwardly protruding wheel wells which open outwardly in a direction away from the interior of said container; each wheel well including a base wall and side walls formed by portions of said floor plate, and a plurality of wheel assemblies mounted in respective ones of said wheel wells, each wheel assembly comprising a yoke mounted to said base wall of its respective wheel well and projecting outwardly therefrom and a wheel rotatably mounted on said yoke.

2. Luggage according to claim 1, wherein said container includes a pair of front corners located remotely of said rear wall, and a pair of stiffening plates disposed along the inside of said front corners to reinforce same, said stiffening plates extending no further than said second peripheral edge.

3. Luggage according to claim 2 including a one-piece, three-sided metallic reinforcing bar extending along the inside of said container, said bar being of shorter height than the container and including two ends which overlap said curved ends of said floor plate and are secured to the latter.

4. Luggage according to claim 3, wherein said skirt includes a pair of front corners located remotely of the rear corners of said skirt, pockets formed on the inside of said skirt front corners, and curved stiffening stays disposed therein.

* * * * *